United States Patent [19]

Kao

[11] Patent Number: 4,756,206

[45] Date of Patent: Jul. 12, 1988

[54] WINDOW/DOOR STABILIZING APPARATUS

[76] Inventor: Lung-Chia Kao, 6F, No. 5-1, 38 Lane, HouKang Street, Shih Lin, Taipei, Taiwan

[21] Appl. No.: 59,409

[22] Filed: Jun. 8, 1987

[51] Int. Cl.[4] ..... G05G 1/00

[52] U.S. Cl. ..... 74/511 R; 74/606 R; 49/34; 248/500

[58] Field of Search ..... 49/342, 341, 339; 248/300, 500, 558; 24/287; 24/287; 74/511 R, 606 R

[56] References Cited

U.S. PATENT DOCUMENTS

| | | | |
|---|---|---|---|
| 1,313,494 | 8/1919 | McNeill | 248/500 |
| 2,119,048 | 5/1938 | Garrison | 49/341 |
| 2,762,597 | 9/1956 | Jaworski | 248/500 |
| 3,319,482 | 5/1967 | Campbell | 74/606 R |
| 3,388,885 | 6/1968 | Holmes | 248/500 |
| 3,422,695 | 1/1969 | Wilson | 74/606 R |
| 3,722,311 | 3/1973 | Northrup | 74/606 R |

*Primary Examiner*—Kenneth J. Dorner
*Assistant Examiner*—Gerald A. Anderson
*Attorney, Agent, or Firm*—Bacon & Thomas

[57] ABSTRACT

An improved stabilizer for a window or door which a stabilizing element with two screwing holes thereon and extending two separate insert legs which are approximately perpendicular to the stabilizing element so that the stabilizing element is able to engage with the stabilizing apparatus and to fix with the stabilized windowsill.

3 Claims, 4 Drawing Sheets

WINDOW/DOOR STABILIZING APPARATUS

BACKGROUND OF THE INVENTION

This invention relates to an improved stabilizing apparatus for a window or door, especially to the improvements concerning the stabilization of an Aluminium-framed window or door.

Presently, there are two popular types of windows in general use in buildings: the pull type and the push type The push type of window, as shown in FIG. 6, shows the window been pulled outwardly and which comprises a long blocking strip 4 on the windowsill 3 for controlling the window being at a fixed position when closed. For controlling and stabilizing the window at appropriate opened or closed positions, this push type of window also has a stabilizing apparatus 1. The stabilizing apparatus 1, as seen in FIG. 1, comprises a hollow rectangular body 10 and a flat plate 12 extending from the lower portion of the hollow rectangular body 10. The hollow rectangular body 10 has an opening 11 on the side toward the flat plate 12 and also has a protuberance 19 with a hollow tube on the top thereof. A movable connecting arm 13 is disposed in the hollow rectangular body 10 with the toothed end thereof pivotted at the position A. An adjustment element 14 comprises a threaded head 141 and a handle 142 wherein the threaded head 141 is concealed in the hollow rectangular body 10 and the handle 142 connected with the threaded head 141 protrudes from the protuberance 19. The threaded head 141 of the adjustment element 14 is designed to be engageable with the toothed element 132 of the movable connecting arm 13. Therefore, the movable connecting arm 13 will move horizontally as the handle 142 of the adjustment element 14 is rotated clockwise or counterclockwise. The other end of the movable connecting arm 13 has a rotatable element 131 which connects to the rack on the bottom of the window so that the window will move with the movable connecting arm 13.

Now referring to FIG. 5 and 6, an embodiment of the stabilizing apparatus of the prior art can be seen. The stabilizing apparatus is installed on the windowsill 3 by passing through the long blocking strip 4 and is fixed to the windowsill 3 by screwing them together via a pair of separate holes 16 on the flat plate 12. In general, the flat plate 12 has two pairs of holes 16 and 18 for fixing, but the pair of holes 18 is useless for being blocked by the long blocking strip 4. Therefore, when the stabilizing apparatus is used in Aluminium door frames or plastic-framed windows, the stabilizing effect is not very good because the hollow chracteristic of these materials.

In order to provide a better stabilizing effect, this invention has added an external stabilizing bracket 2 which has two separate insert legs 21 extending approximately perpendicularly from the bracket 2, which can be inserted into the stabilizing means 1 for increasing stability.

SUMMARY OF THE INVENTION

The principal object of this invention is to provide an external stabilizing bracket combined with a stabilizing means to increase the stability of the stabilizing means.

Further objects and advantages of the present invention will become apparent as the following description proceeds, and the features of novelty which characterize the invention be pointed out with paraticularity in the claims annexed to and forming a part of this invention.

DETAILED DESCRIPTION OF THE INVENTION

Figure 1:
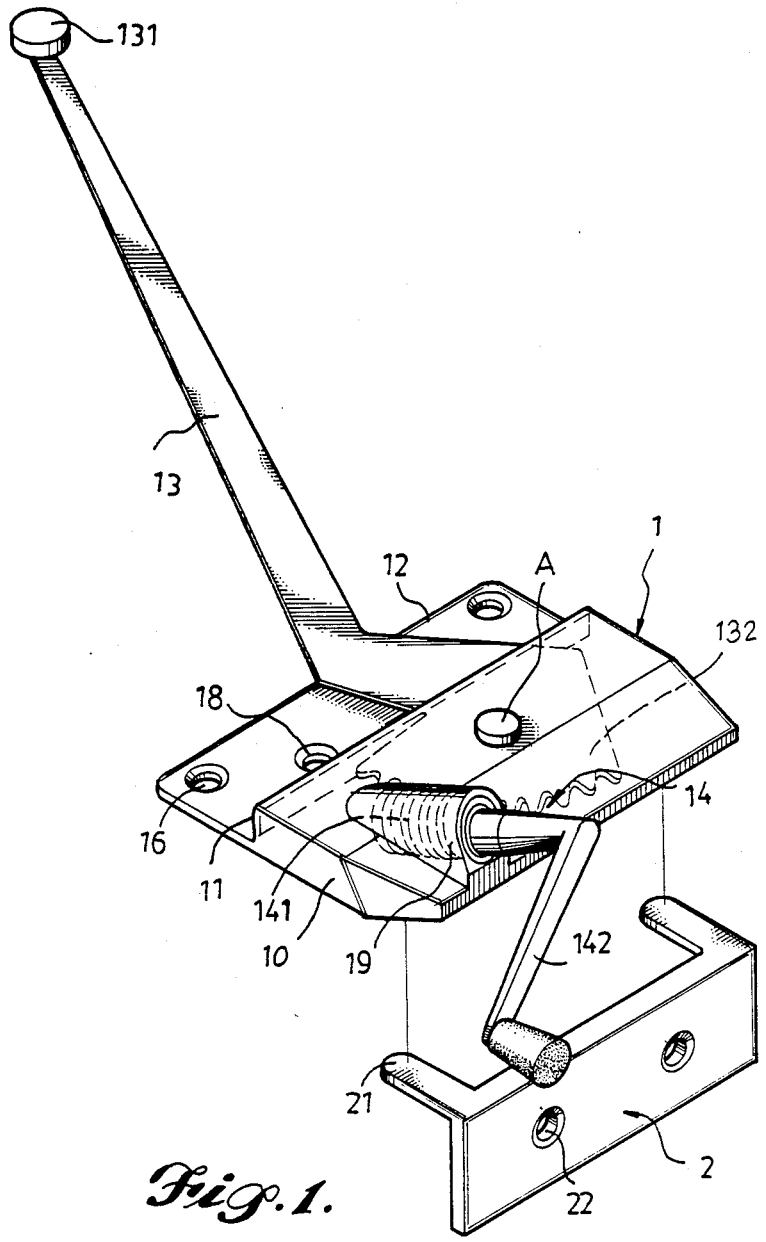
FIG. 1 shows a perspective view of this invention.
Figure 2:
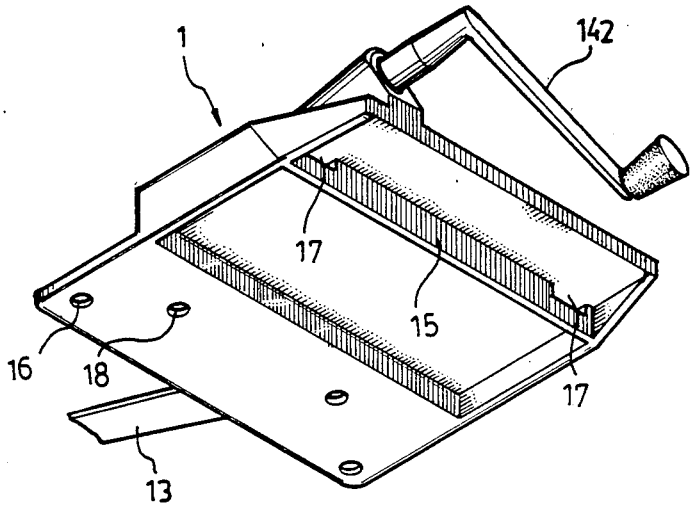
FIG. 2 shows a bottom view of this invention.

Referring to FIGS. 1 and 2, this invention is formed of a stabilizing means 1 and a stabilizing bracket 2. The stabilizing means 1 is similar to a conventional one, but the difference is that a beam 15 is installed on the cavity on the bottom of the rectangular body 10 and this beam 15 is set with two separate slots 17. The stabilizing bracket 2 comprises two insert legs 21 extending approximately perpendicularly from right and left terminals of the upper end thereof. The width of the insert leg 21 is equal to that of the slot 17 and the distance between two legs 21 is also equal to that between the slots 17 so that the stabilizing bracket 2 can engage with the stabilizing means 1. Further, the stabilizing bracket 2 has two holes 22 bored thereon for being used for fixing the bracket 2 with the windowsill 3 disposed under the stabilizing means 1.

Figure 3:
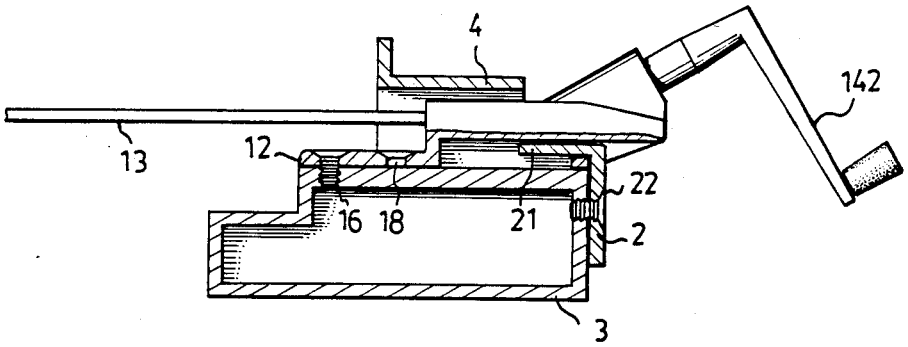
FIGS. 3 and 4 show various embodiments of this invention.
Figure 4:
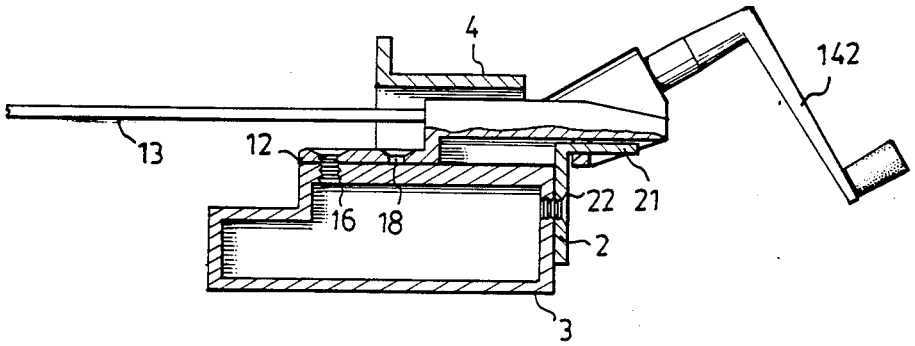
Figure 5:
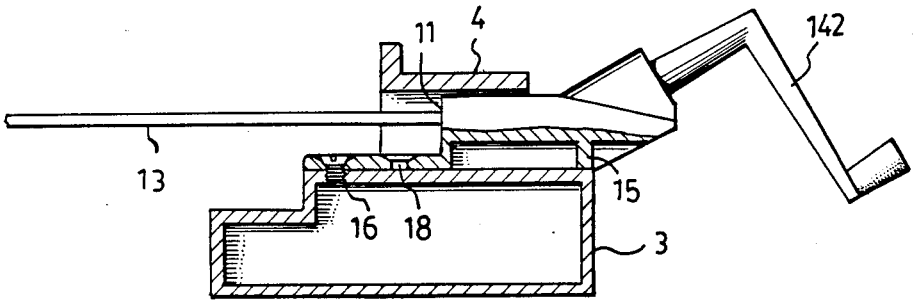
Prior Art Fig. 5.
FIGS. 5 and 6 show various embodiments of the prior art.
Figure 6:
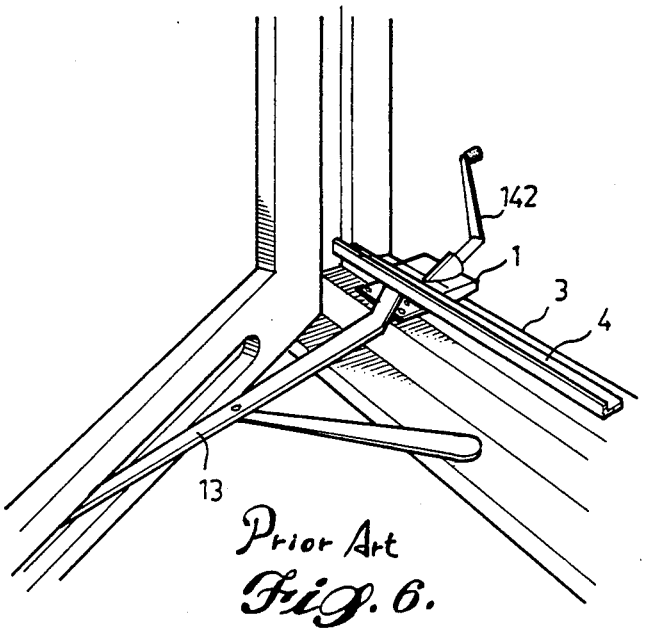
Prior Art Fig. 6.

Now referring to FIGS. 3 and 4, two embodiments of the present invention can be seen. As mentioned above, the stabilizing means 1 is installed on the windowsill 3 by passing through the blocking strip 4 and the rotatable element 131 of the movable connecting arm 13 is connected to the slipping rack (not shown) of the window. Then, inserting the legs 21 of the stabilizing bracket 2 into the slots 17 of the stabilizing means 1 and threading screws into the holes 22 provide the stabilized window with better stability.

When applied in various windows with various thicknesses, the stabilizing bracket 2 and the stabilizing means 1 may be connected in two manners. FIG. 3 shows the beam 15 of the stabilizing means 1, being on the windowsill 3, then, as this figure shows, the insert legs 21 of the stabilizing bracket 2 insert the slots 17 of the beam 15 from outside to inside. But if the beam 15 is outside the windowsill 3, as shown in FIG. 4, then the insert legs 21 should insert the slots 17 from inside to outside and then the stabilizing bracket 2 is attached to the windowsill 3. Finally, secure the stabilizing backet 2 to the windowsill 3 through the holes of the stabilizing bracket 2 with screws.

The angle between the stabilizing bracket 2 and the insert legs 21 is little smaller than 90 degrees, but according to the material elasticity, the stabilizing bracket 2 is able to attach completely to the windowsill 3. Further, the inserting position of the insert legs 21 on the slots 17 is adjustable as required to insert from outside or inside. Therefore, the stabilizing apparatus of this invention provides better stability than the prior art.

As various possible embodiments might be made of the above invention without departing from the scope of the invention, is to be understood that all matter herein described or shown in the accompanying drawing is to be interpreted as illustrative and not in a limiting sense. Thus it will be appreciated that the drawings are exemplary of a preferred embodiment of the invention.

I claim:

1. An improved stabilizing apparatus for a window or door comprising a stabilizing means and a stabilizing bracket;

said stabilizing means having a hollow rectangular body; a flat plate extending from a lower portion of said hollow rectangular body; said rectangular body having a pivotable connecting arm with a toothed end, and an adjustment handle with a corresponding threaded head so that rotating said adjustment handle moves said connecting arm; a bottom surface of said rectangular body forming a cavity with a beam therein; said beam having two slots thereon;

said stabilizing bracket having two screwing holes and having two insert legs extending from a left and right terminal on an upper end of said stabilizing bracket; the width of said insert legs and the distance therebetween being equal to the width of said slots and the distance between said slots, respectively; said insert legs being insertable into said slots.

2. An improved stabilizing apparatus as claimed in claim 1, wherein the angle between said insert legs and said stabilizing bracket is slightly less than 90 degrees.

3. An improved stabilizing apparatus as claimed in claim 1, wherein said insert legs are inserted into said slots either from outside to inside thereof or from inside to outside thereof.

* * * * *